US007789679B2

(12) United States Patent
Wu et al.

(10) Patent No.: US 7,789,679 B2
(45) Date of Patent: Sep. 7, 2010

(54) CABLE ASSEMBLY WITH DUSTPROOF COVER MODULE

(75) Inventors: Xiao-Gang Wu, Kunshan (CN); Ping-Sheng Su, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/499,654

(22) Filed: Jul. 8, 2009

(65) Prior Publication Data

US 2010/0009561 A1 Jan. 14, 2010

(30) Foreign Application Priority Data

Jul. 8, 2008 (CN) ..... 2008 2 0301479

(51) Int. Cl.
*H01R 13/44* (2006.01)

(52) U.S. Cl. ..... 439/135

(58) Field of Classification Search ..... 439/135, 439/136, 142, 147
See application file for complete search history.

(56) References Cited

U.S. PATENT DOCUMENTS 3,725,845 A * 4/1973 Moulin ..... 439/291
4,365,858 A * 12/1982 Karol ..... 439/135
5,547,388 A * 8/1996 Hill ..... 439/135
5,984,724 A * 11/1999 McNeel ..... 439/606
7,249,964 B1 * 7/2007 Hoffman et al. ..... 439/471
7,442,077 B2 * 10/2008 Peress et al. ..... 439/505
7,534,132 B2 5/2009 Kuo et al.
7,547,218 B2 * 6/2009 Hiew et al. ..... 439/135
2007/0004255 A1 * 1/2007 Kuo ..... 439/136
2009/0163058 A1 * 6/2009 Craig et al. ..... 439/147

* cited by examiner

*Primary Examiner*—Michael C Zarroli
(74) *Attorney, Agent, or Firm*—Wei Te Chung; Andrew C. Cheng; Ming Chieh Chang

(57) ABSTRACT

A cable assembly, comprises at least one connector defining a mating portion; a cable electrically connected to the connector; and a dustproof cover module attached to the cable. The dustproof cover module comprises at least one dustproof cover for covering the mating portion of the connector and a carrier comprising a base portion having at least one receiving room therein and a tie extending from a rear surface of the base portion. The dustproof cover is received into the receiving room, the tie engages with the base portion to make the carrier surrounding the cable and holding the dustproof cover positioned in the base portion of the carrier.

19 Claims, 9 Drawing Sheets

CABLE ASSEMBLY WITH DUSTPROOF COVER MODULE

FIELD OF THE INVENTION

The present invention relates to cable assembly, particularly to a cable assembly with a dustproof cover module removeably attached to a cable of the cable assembly.

DESCRIPTION OF PRIOR ART

Dustproof cover are widely applied to the cable assembly in order to protect an interface of a connector before its interconnection with a mating connector from being contaminated by dust particles, moisture and other substances to ensure a good performance of information transmission. U.S. Pat. No. 7,534,132 B2 issued on May 19, 2009 discloses a dustproof cover fitted to a mating portion of the cable assembly, when the cable assembly is in use, the dustproof cover should be removed, however, the dust cover tends to get lost after it is removed.

As discussed above, an improved cable assembly overcoming the shortages of existing technology is needed.

SUMMARY OF THE INVENTION

Accordingly, an object of the present invention is to provide a cable assembly with a dustproof cover module attached to the cable assembly for preventing a dustproof cover disposed in the dustproof cover module from being lost.

In order to achieve the above-mentioned objects, a cable assembly comprises at least one connector defining a mating portion; a cable electrically connected to the connector; and a dustproof cover module attached to the cable. The dustproof cover module comprises at least one dustproof cover for covering the mating portion of the connector and a carrier comprising a base portion having at least one receiving room therein and a tie extending from a rear surface of the base portion. The dustproof cover is received into the receiving room, the tie engages with the base portion to make the carrier surrounding the cable and holding the dustproof cover positioned in the base portion of the carrier.

Other objects, features and advantages of the invention will be apparent from the following detailed description taken in connection with the accompanying drawings.

DETAILED DESCRIPTION OF PREFERRED EMBODIMENTS

Figure 1:
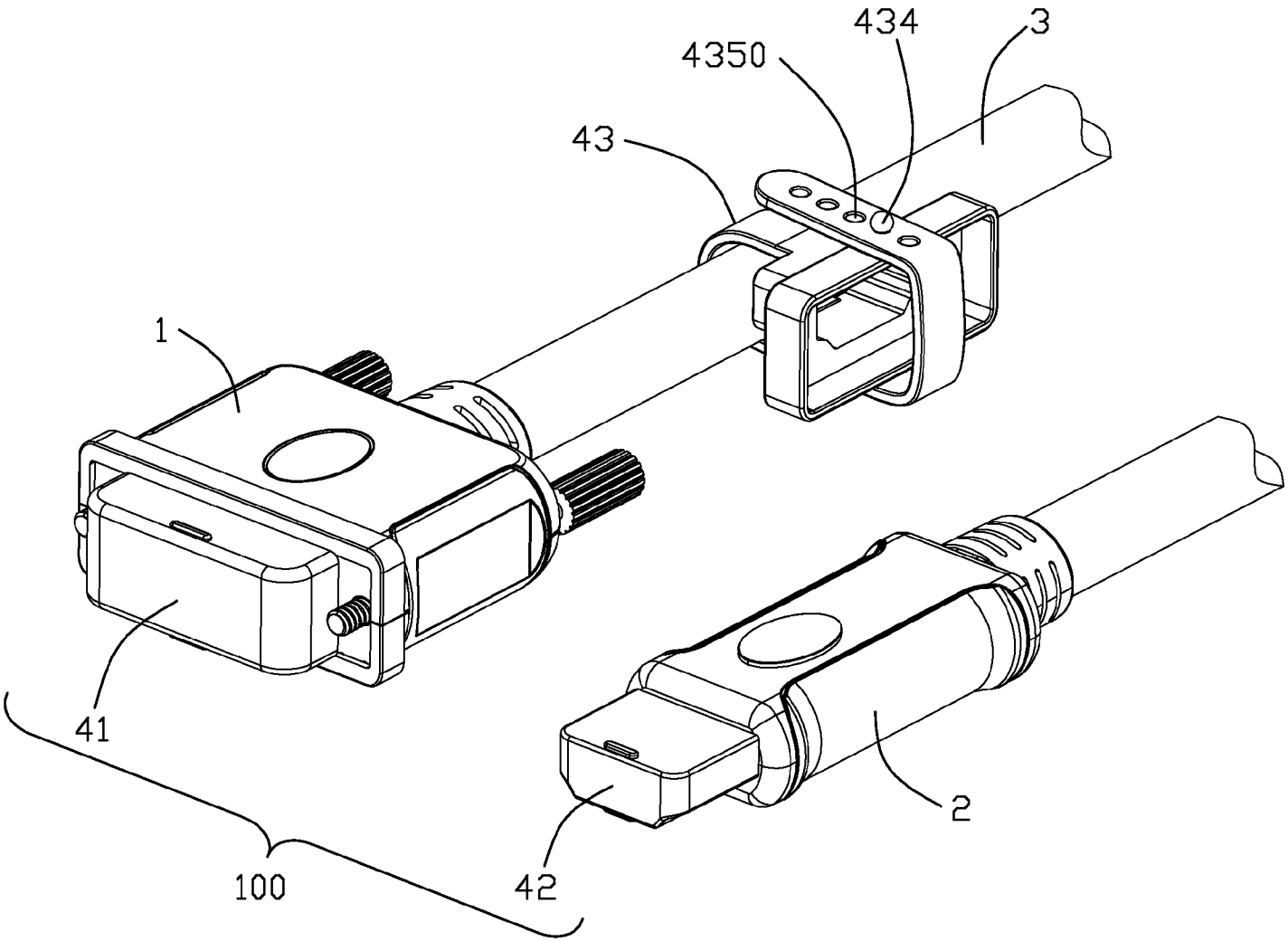
FIG. 1 is a perspective view of a cable assembly of a first embodiment in accordance with the present invention, and a pair of dustproof covers are respectively fitted to cover the pair of connectors of the cable assembly.

Reference will now be made to the drawing figures to describe the present invention in detail.

Figure 2:
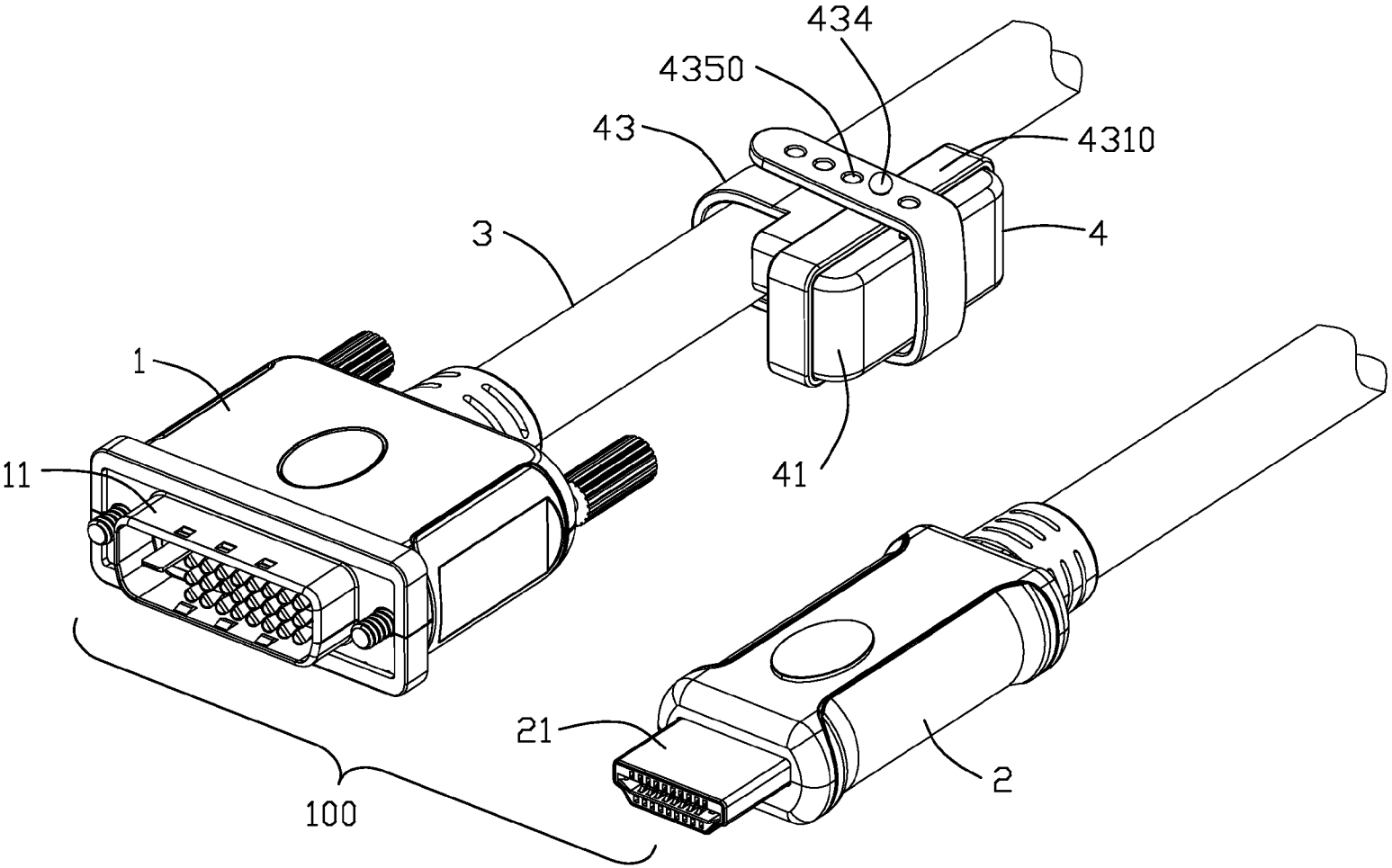
FIG. 2 is a perspective view of a cable assembly of the first embodiment in accordance with the present invention, and the pair of dustproof covers are received into a carrier of the cable assembly.

Referring to FIGS. 1 and 2, a cable assembly of the first embodiment made in accordance with the present invention, generally designated 100, is adapted for mating with a plurality of complementary connectors (not shown). The cable assembly 100 defines a first connector 1, a second connector 2, a cable 3 electrically connected with the first and second connectors 1, 2 and a dustproof cover module 4 attached to the cable 3. In the first embodiment, the first connector 1 is a DVI (Digital Visual Interface) connector, and the second connector 2 is a HDMI connector.

Figure 3:
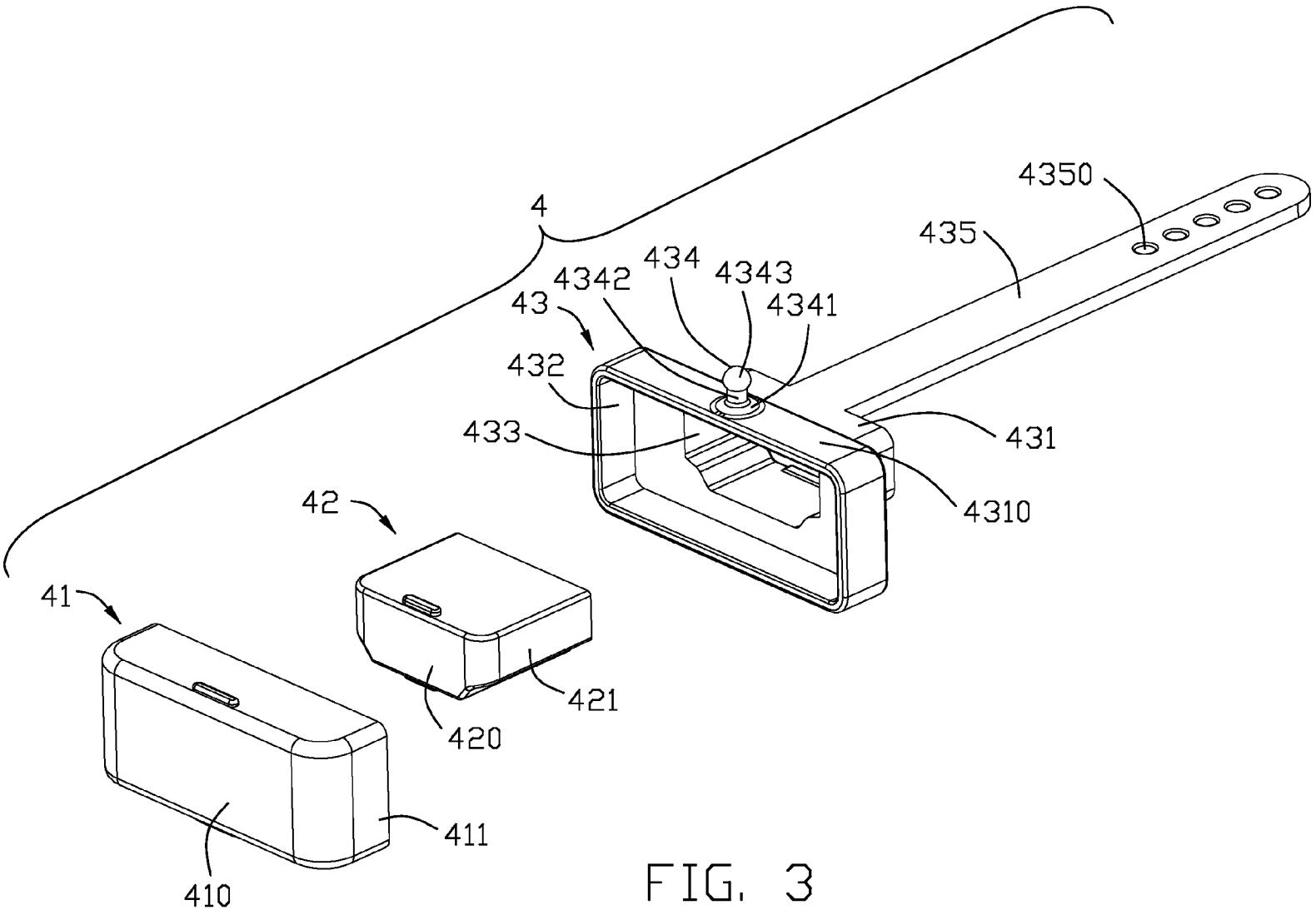
FIG. 3 is an exploded, perspective view of a dustproof cover module of the cable assembly of the first embodiment in accordance with the present invention.
Figure 4:
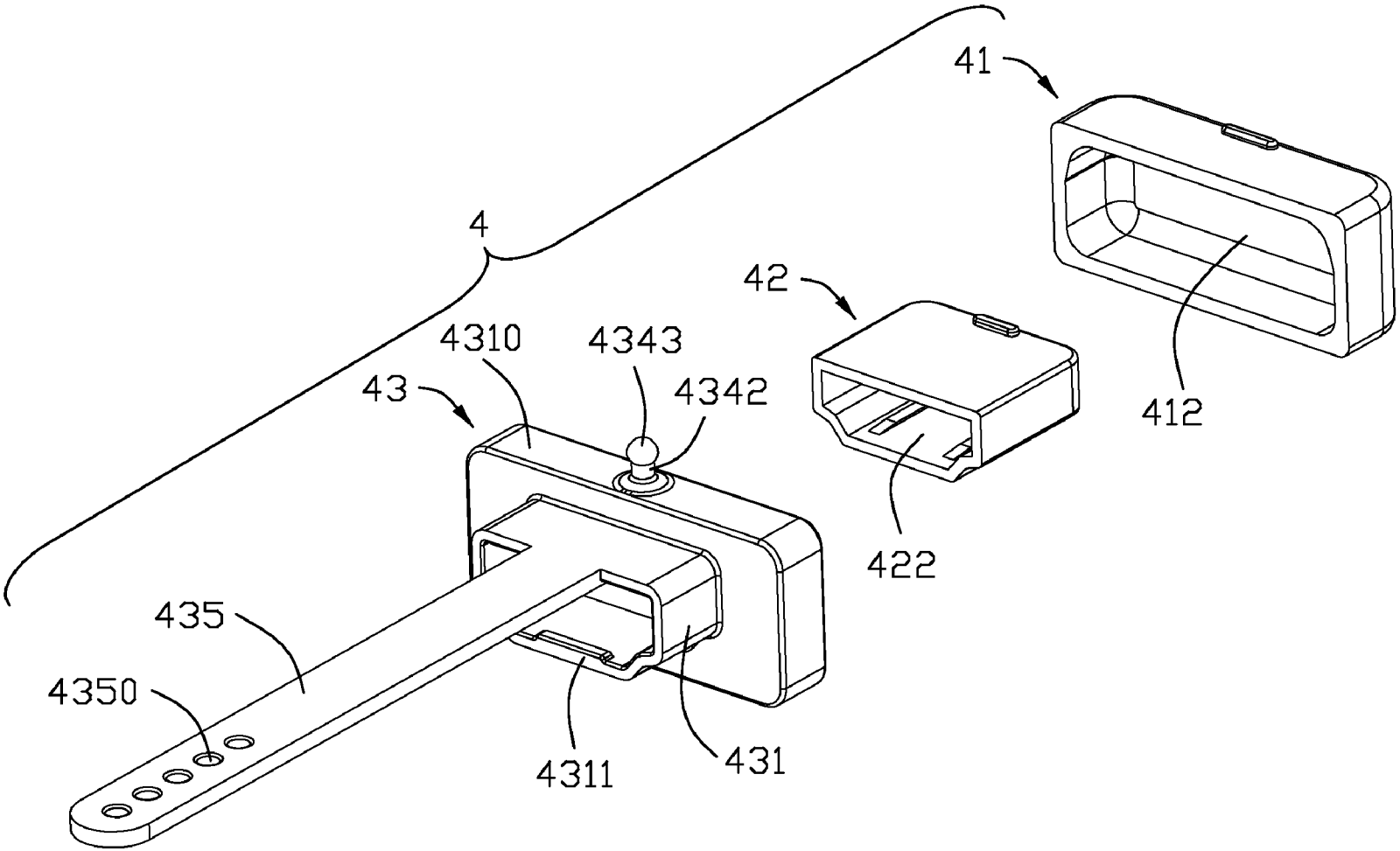
FIG. 4 is similar to FIG. 3, but viewed from another aspect.
Figure 5:
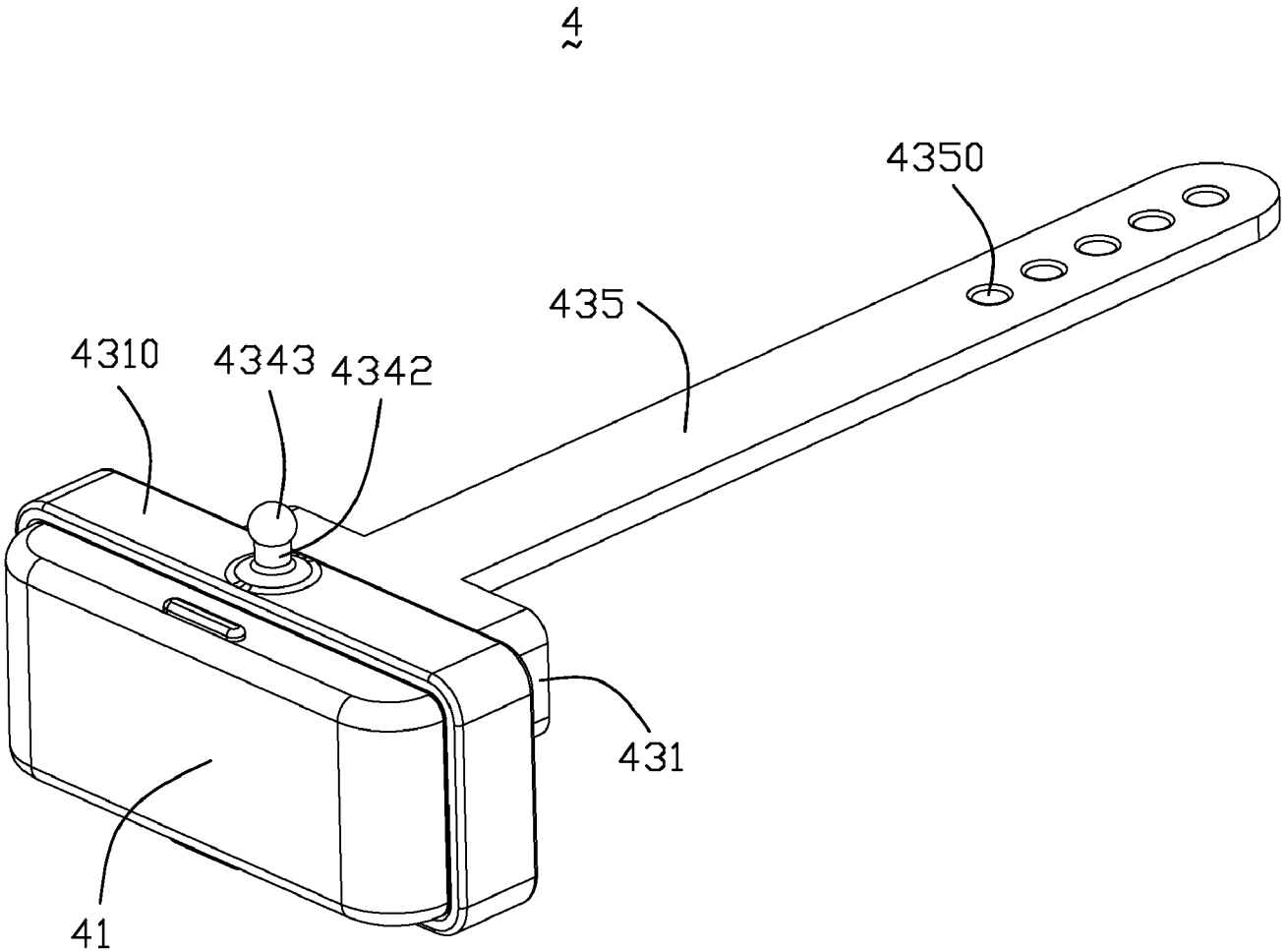
FIG. 5 is an assembled, perspective view of a dustproof cover module of FIG. 3.

Referring to FIGS. 3 to 5, the dustproof cover module 4 includes a first dustproof cover 41, a second dustproof cover 42 and a carrier 43. The first dustproof cover 41 defines a top wall 410 and a side wall 411 extending from circumference of the top wall 410. A receiving cavity 412 enclosed by the top wall 410 and a side wall 411 is fitted to receive a mating portion 11 of the first connector 1. The length of the side wall 411 is the same with that of the mating portion 11 of the first connector 1. So the first dustproof cover 41 is fully fitted to cover the mating portion 11 of the first connector 1. The second dustproof cover 42 also defines a top wall 420 and a side wall 421 extending from circumference of the top wall 420. A receiving cavity 422 enclosed by the top wall 420 and a side wall 421 is fitted to receive a mating portion 21 of the first connector 2. The length of the side wall 421 is the same with that of the mating portion 21 of the first connector 2. So the second dustproof cover 42 is fully fitted to cover the mating portion 21 of the first connector 2. The first and second dustproof covers 41, 42 are both used to prevent the mating portions 11, 21 of the first and second connector 1, 2 from being dirtied by dust particles when the first and second connectors are not in use. The area of the top wall 410 of the first dustproof cover 41 is larger than that of the top wall 420 of the second dustproof cover 42. The first and second dustproof covers 41, 42 can be received and positioned in the carrier 43 which can be bundled to the cable 3 or other place of the cable assembly 100. So, the first and second dustproof covers 41, 42 will not be easily lost when the cable assembly 100 is in use.

Also referring to FIGS. 3 and 5, the carrier 43 of the dustproof cover module 4 of the cable assembly 100 is formed of insulative material and defines a base portion 431 and a tie 435 extending along a longitudinal direction from a rear surface 4311 of the base portion 431.

The base portion 431 of the carrier 43 defines a first receiving room 432 for receiving the first dustproof cover 41 and a second receiving room 433 for receiving the second dustproof cover 42. The first receiving room 432 and second receiving room 433 are arranged side by side along a longitudinal direction and communicated with each other. The second receiving room 433 is formed in a rear section of the base portion 431 and the first receiving room 432 is formed in a front section of the base portion 431. The second receiving room 433 is smaller than the first receiving room 432. The second dustproof cover 42 should be received into the second receiving room 433 before the first dustproof cover 41 received into the first receiving room 432 so that the first and second dustproof cover 41, 42 can be both received into the base portion 431. A protrusion 434 is formed on a top wall 4310 of the base portion 431. The protrusion 434 defines a bottom portion 4341 connected to the top wall 43 10, a column portion 4342 extending upwardly form the bottom portion 4341 and a ball portion 4343 formed on a top end of the column portion 4342. The diameter of the ball portion 4343 is larger than that of the column portion 4342.

The tie 435 is flexible and elastic, it defines a plurality of through hole 4350 at a free end thereof and extending in a vertical direction. The diameter of the through 4350 is smaller than that of the ball portion 4343 of the protrusion 434 and larger than that of the column portion 4342 of the protrusion 434. The tie 435 can be bent to make the ball portion 4343 corresponding to the through hole 4350, then the ball portion 4343 can be passed through the through hole 4350 and the column portion 4342 can be received into the through hole 4350. So, the tie 435 can be engaged with protrusion 434 of the carrier 43 to form a bundling region and to hold the first and second dustproof covers 41, 42 positioned in the carrier 43. And the protrusion 434 of the carrier 43 can cooperate with different through hole 4350 to define the bundling region in a small or larger size.

Referring to FIGS. 1 and 2, when the first and second connectors 1, 2 of the cable assembly 100 are mating with the complementary connectors, the first dustproof cover 41 and second dustproof cover 42 are both received into the first and second receiving room 432, 433 in turn. Then making the rear surface 4311 the base portion 431 of the carrier 43 attached to an outer surface of the cable 3. Then bending the tie 435 to surround the cable 3 and the first dustproof cover 41. At last, engaging the tie 435 to the protrusion 434 of the carrier 43 through the ball portion 4343 of the protrusion 434 passed through the through hole 4350 of the tie 435. So, the first and second dustproof cover 41, 42 are well positioned in the base portion 431 of the carrier 43.

When the first and second connectors 1, 2 of the cable assembly 100 are not in use, the first and second dustproof covers 41, 42 are respectively fitted to cover the mating portions 11, 21 of the first connector and second connector 1, 2 for preventing the mating portions 11, 21 from being dirtied by dust particles. And the carrier 43 is also bundled to the cable 3 to prevent the carrier 43 from being lost.

Figure 6:
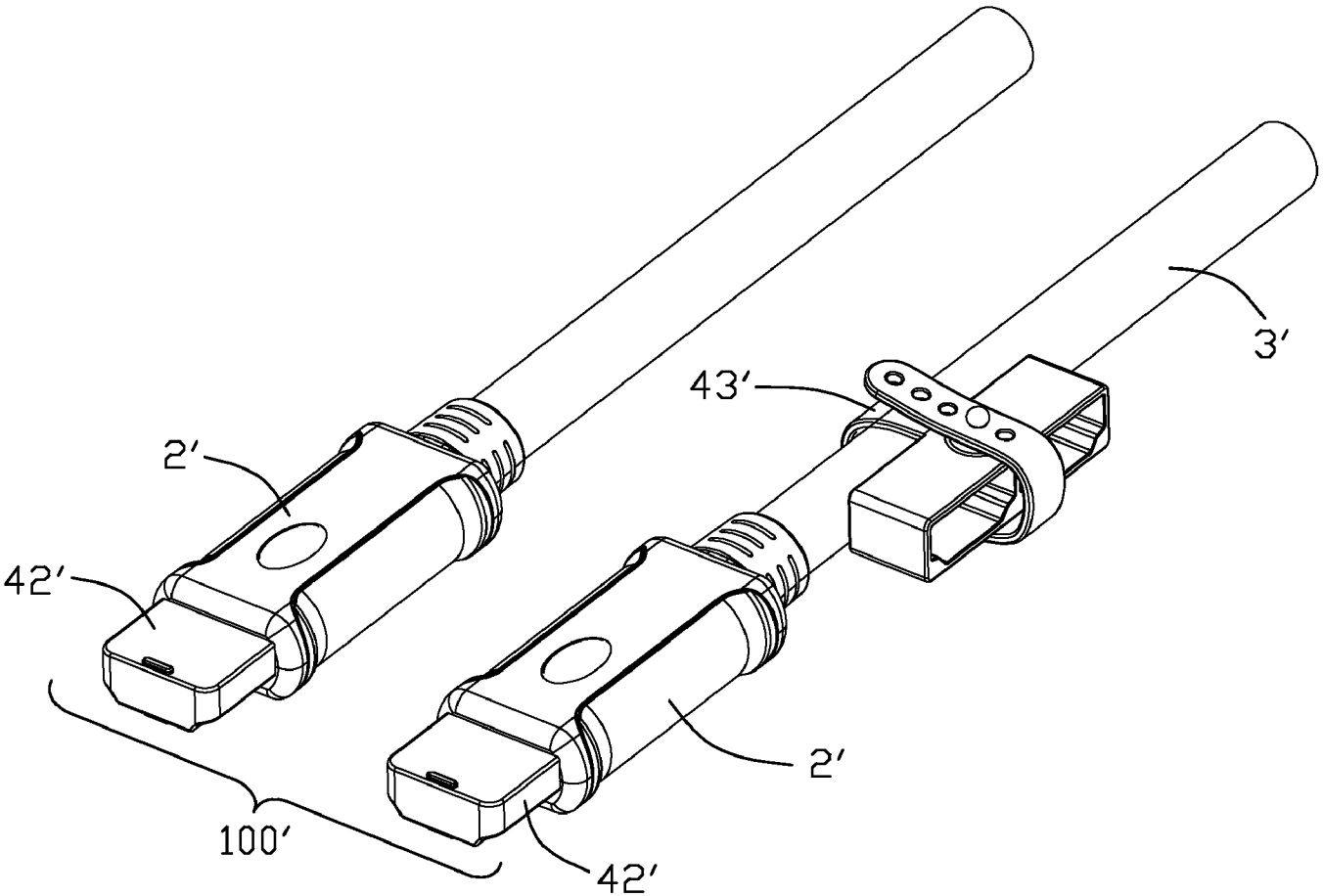
FIG. 6 is a perspective view of a cable assembly of a second embodiment in accordance with the present invention, and a pair of dustproof covers are respectively fitted to cover the pair of connectors of the cable assembly.
Figure 7:
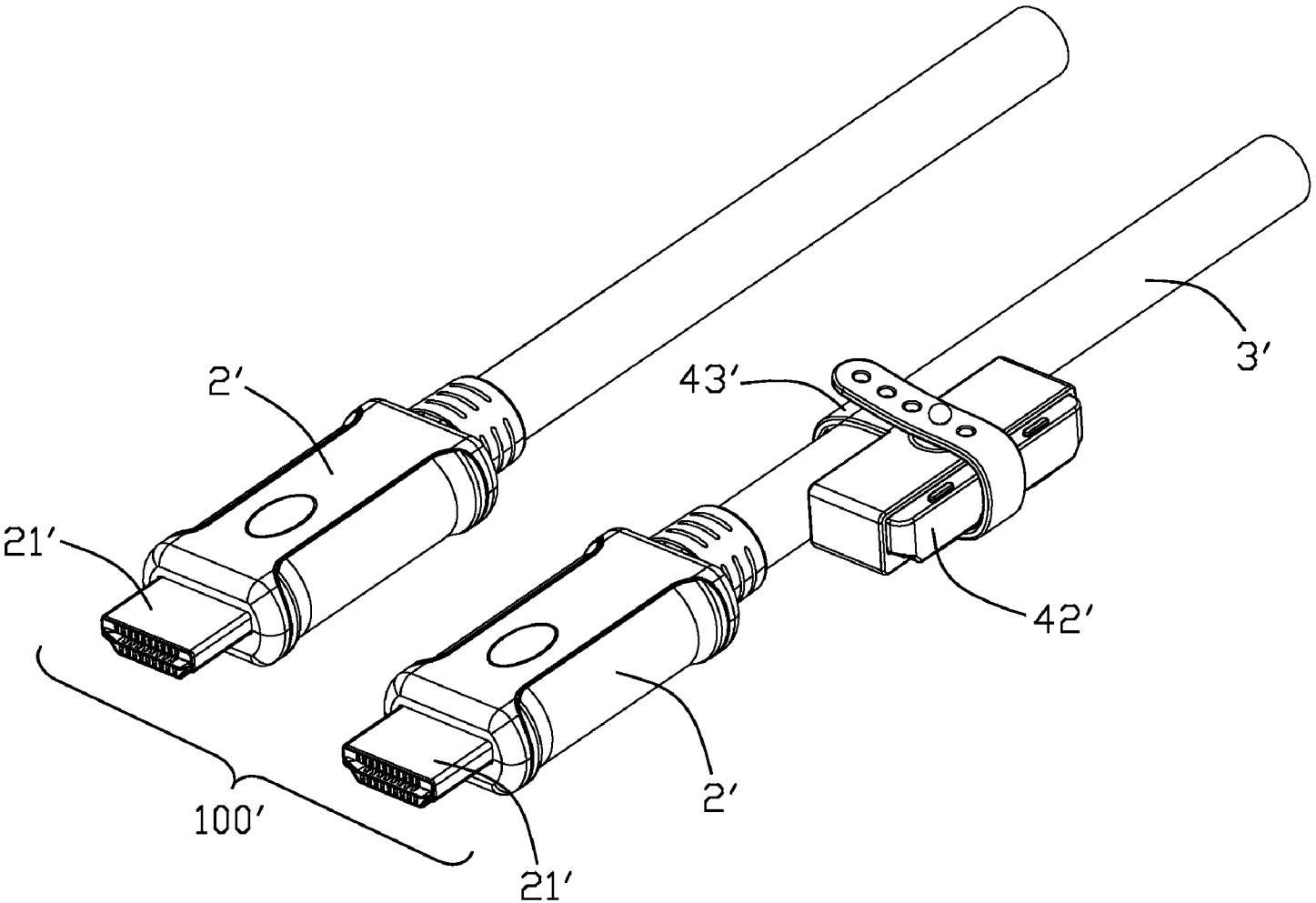
FIG. 7 is a perspective view of the cable assembly of the second embodiment in accordance with the present invention, and the pair of dustproof covers are received into a carrier of the cable assembly.

Referring to FIGS. 6 and 7, a cable assembly of a second embodiment made in accordance with the present invention, generally designated 100', is adapted for mating with a pair of complementary connectors (not shown). The cable assembly 100' defines a pair of connectors 2' and a cable 3' electrically connected with the pair of connectors 2' and a dustproof cover module 4'. The connector 2' defines a mating portion 21' at a front end thereof. In the second embodiment, the connector 2' is also a HDMI connector.

In the second embodiment, the dustproof cover module 4' includes a pair of dustproof covers 42' and a bunding tie 43'. The dustproof cover 42' has a same structure with the second dustproof 42 in the first embodiment.

Figure 8:
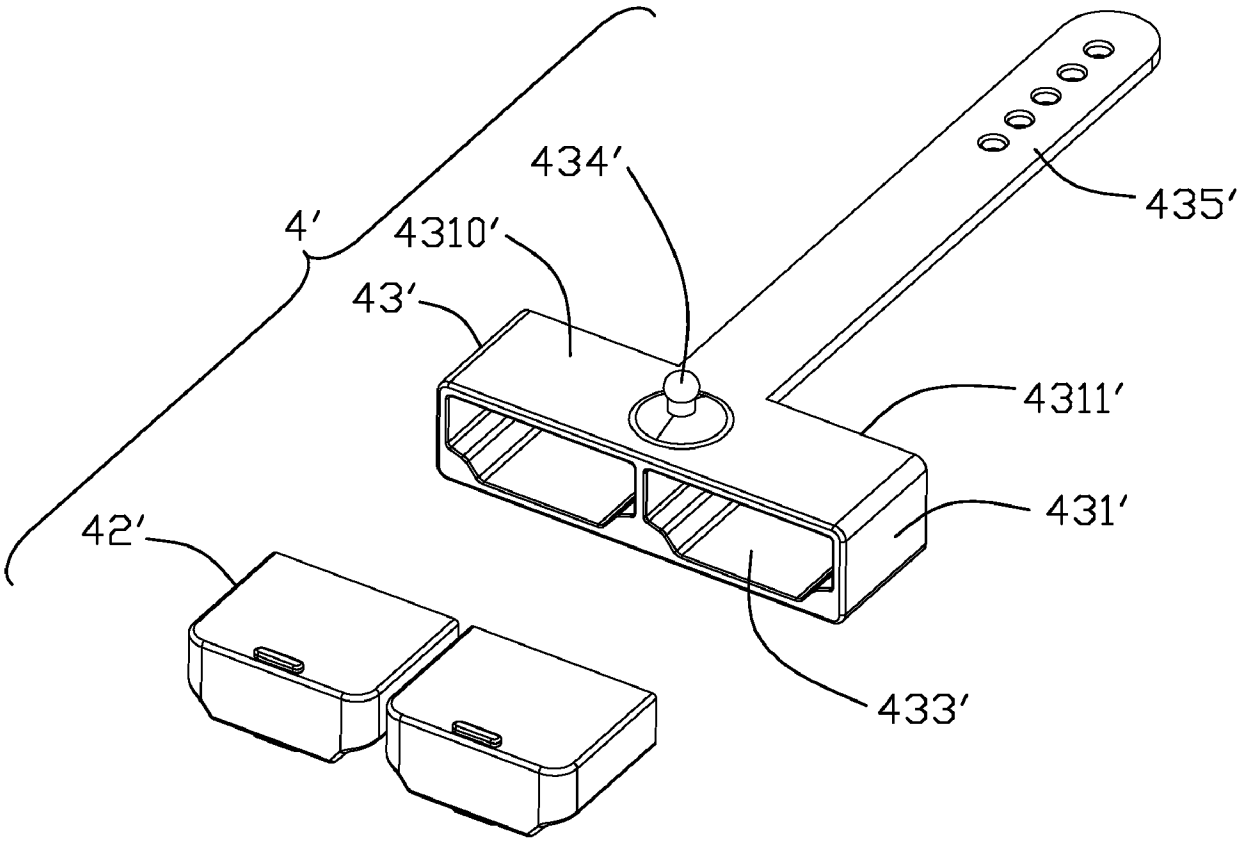
FIG. 8 is an exploded, perspective view of a dustproof cover module of a cable assembly of the second embodiment in accordance with the present invention.
Figure 9:
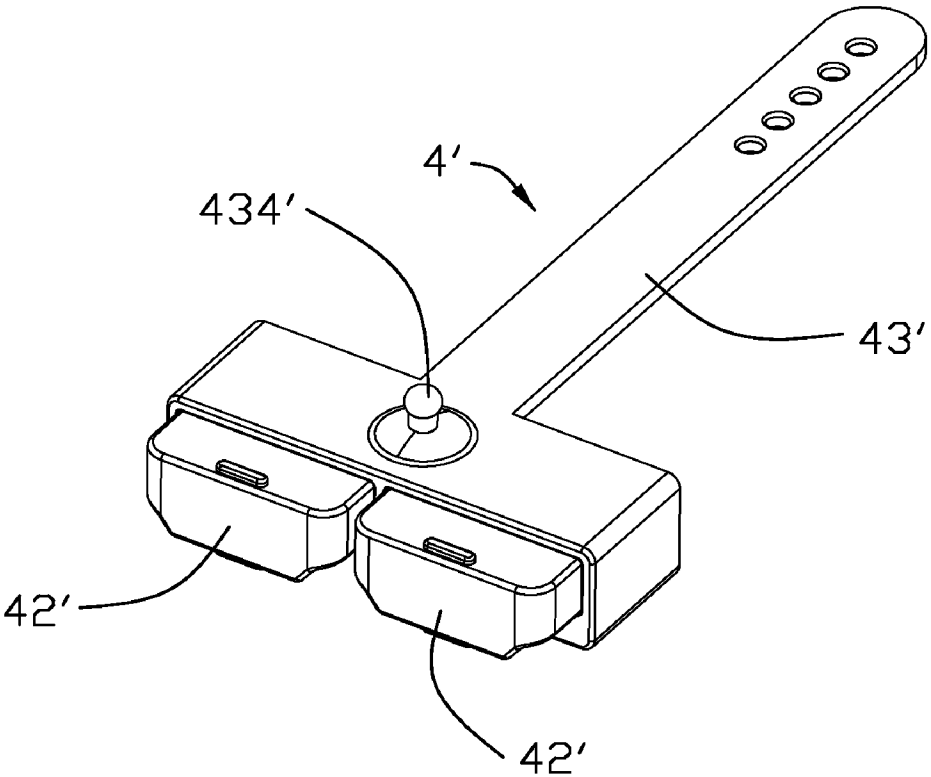
FIG. 9 is an assembled, perspective view of the dustproof cover module of FIG. 8.

Also referring to FIGS. 8 and 9, the carrier 43' of the dustproof cover module 4' of the cable assembly 100' defines a base portion 431' and a tie 435' extending along a longitudinal direction from a rear surface 4311' of the base portion 431'. The base portion 431' defines a pair of receiving rooms 433' arranged side by side in a widthwise direction for receiving the pair of dustproof covers 42'. A protrusion 434' is formed on a top wall 4310' of the base portion 431'. The protrusion 434' has a same structure with the protrusion 434 in the first embodiment. The tie 435' also has a same structure with the tie 435 in the first embodiment.

Referring to FIGS. 6 and 7, when the pair of connectors 2' of the cable assembly 100' are mating with the complementary connectors, the pair of dustproof covers 42' are received into the pair of receiving rooms 433'. Then making the rear surface 4311' the base portion 431' of the carrier 43' attached to an outer surface of the cable 3'. Then bending the tie 435' to surround the cable 3' and the pair of dustproof covers 42'. At last, engaging the tie 435' to the protrusion 434' of the carrier 43'. So, the pair of dustproof covers 42' are well positioned in the base portion 431' of the carrier 43'.

When the pair of connectors 2' of the cable assembly 100' are not in use, the pair of dustproof covers 42' are respectively fitted to cover the mating portions 21' of the pair of connectors 2' for preventing the mating portions 21' from being dirtied by dust particles. And the carrier 43' is also bundled to the cable 3' to prevent the carrier 43' from being lost.

It should be noted that the method of the dustproof cover module 4, 4' of the first and second embodiment of the cable assembly 100, 100' bundled to the cable 3, 3' is the same with each other. However the structure of the base portion 431, 431' of the dustproof cover module 4, 4' is different from each other.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

at least one connector defining a mating portion;

a cable electrically connected to the connector; and a dustproof cover module attached to the cable, and comprising at least one dustproof cover that can be separated from the module and attached to and covering the mating portion of the connector and a carrier comprising a base portion having at least one receiving room therein and a tie extending from the base portion, the dustproof cover can be detached and received into the receiving room, the tie engaged with the base portion with the carrier tie wrapped around the cable and the dustproof cover positioned in the base portion of the carrier, when not connected to the mating portion of the connector.

2. The cable assembly as recited in claim 1, wherein the connector includes a first connector and a second connector, the dustproof cover includes a first dustproof cover and a second dustproof cover, and the receiving room includes a first receiving room and a second receiving room.

3. The cable assembly as recited in claim 2, wherein the first and second receiving rooms of the base portion of the carrier are arranged side by side along the extending direction of the tie.

4. The cable assembly as recited in claim 2, wherein the first and second receiving rooms of the base portion of the carrier are arranged side by side along a widthwise direction.

5. The cable assembly as recited in claim 3, wherein the first receiving room is smaller than the second receiving room, the first dustproof cover is also smaller than the second dustproof cover in size.

6. The cable assembly as recited in claim 4, wherein the first receiving room is the same size as the second receiving room, the first dustproof cover has a same structure with the second dustproof cover.

7. The cable assembly as recited in claim 2, wherein the base portion of the carrier defines a protrusion formed on a wall thereof, the tie of the carrier defines a plurality of through holes at a free end thereof for matching with the protrusion.

8. The cable assembly as recited in claim 7, wherein the tie of the carrier is flexible and elastic.

9. The cable assembly as recited in claim 7, wherein the protrusion of the base portion of the carrier defines a bottom portion connected to the wall, a column portion extending upwardly form the bottom portion and a ball portion formed on a top end of the column portion and passed through a hole of the tie.

10. The cable assembly as recited in claim 5, wherein the second receiving room is formed in a rear section of the base portion and the first receiving room is formed in a front section of the base portion.

11. A dustproof cover module for a cable assembly, comprising:

at least one dustproof cover; and a carrier comprising a base portion and a tie extending rearwardly from a rear surface of the base portion, the base portion defining at least one receiving room for receiving the dustproof cover when not connected to a connector, the tie engaged with the base portion and forming a bundling region for wrapping around a cable of the cable assembly and to hold the dustproof cover positioned in the receiving room of the base portion of the carrier, wherein the base portion of the carrier defines a protrusion formed on a wall thereof, the tie of the carrier defines a plurality of through holes at a free end thereof for matching with the protrusion.

12. The dustproof cover module as recited in claim 11, wherein the protrusion of the carrier can cooperate with different through holes to define the bundling region in a small or larger size.

13. The dustproof cover module as recited in claim 11, wherein the connector inclues a first connector and a second connector, the dustproof cover includes a first dustproof cover and a second dustproof cover, and the receiving room includes a first receiving room and a second receiving room for receiving the first and second dustproof covers.

14. The cable assembly as recited in claim 13, wherein the first and second receiving rooms of the base portion of the carrier are arranged side by side along the extending direction of the tie.

15. The cable assembly as recited in claim 13, wherein the first and second receiving rooms of the base portion of the carrier are arranged side by side along a widthwise direction.

16. A cable connector assembly comprising:

first and second connector units side by side arranged with each other, each of said first and second connector units defining a front mating port and a rear cable extension;

first and second covers detachably covering the first and second mating ports, respectively; and a carrier having an accommodating portion with an opening and a strap portion; wherein both said first and second covers are allowed to be received in said accommodating portion via said opening and restrained by said strap blocking said opening.

17. The cable connector assembly as claimed in claim 16, wherein said first cover and said second cover are side by side received in said accommodating portion.

18. The cable connector assembly as claimed in claim 16, wherein said first cover receives said second cover in said accommodating portion.

19. The cable connector assembly as claimed in claim 16, wherein the strap grasps not only the accommodating portion but also one of said cable extension.

* * * * *